US005119876A

United States Patent [19]

Sable

[11] Patent Number: 5,119,876

[45] Date of Patent: Jun. 9, 1992

[54] WELL TOOL

[76] Inventor: Donald E. Sable, 14175 Proton Rd., Dallas, Tex. 75244

[21] Appl. No.: 674,130

[22] Filed: Mar. 25, 1991

[51] Int. Cl.[5] ..... E21B 17/10

[52] U.S. Cl. ..... 166/241.2

[58] Field of Search ..... 166/380, 176, 241; 175/325

[56] References Cited

U.S. PATENT DOCUMENTS 4,182,537 1/1980 Oster ..... 166/241 X
4,668,117 5/1987 Bair ..... 166/241 X
4,809,777 3/1989 Sable ..... 175/325 X
4,997,039 3/1991 Sable ..... 175/325 X

*Primary Examiner*—William P. Neuder

[57] ABSTRACT

A stabilizer rod connectible in a sucker rod string of a sub-surface well pump having a shank of greater diameter than the shanks of the sucker rods of the string and connector means at its opposite ends whose diameter is not greater than that of the connector means at the ends of the sucker rods.

6 Claims, 3 Drawing Sheets

WELL TOOL

This invention relates to well tools and more particularly to sucker rod strings for sub-surface well pumps and to stabilizer bars or rods connectible in such strings to form sections thereof.

BACKGROUND OF THE INVENTION the usual apparatus for pumping well fluids from a producing earth formation through a tubing which extends from the surface to the formation penetrated by the well includes a sub-surface pump whose barrel is connected to the lower end of the tubing and has a plunger or "traveling valve" which is reciprocated in the pump barrel by a sucker rod string. Such sucker rod string normally comprises a plurality of serially connected sucker rods of relatively great lengths, twenty-five or thirty feet long, and having shanks of relatively small diameter, and a stabilizer bar or rod of much shorter length, for example two to five feet, connected to the bottom end of the lowermost sucker rod. Such stabilizer rod is of greater rigidity then the sucker rods not only because of its much shorter length, but also because of the greater diameter of its shake as compared to that of the shanks of the sucker rods, for example, one inch compared to three quarters of an inch. The bottom end of the stabilizer rod is connected either directly to the "traveling valve" and its top end may be connected to the bottom end of the lowermost sucker rod or, if sinker rods, which are used to accelerate the rod strings downward movement during the down stroke of the reciprocal pumping cycle, are in the lowermost position in the string, to the lowermost sinker rod.

The top rod of the sucker rod string is connected to a motor driven means for alternately pulling the sucker rod string upwardly and then allowing the string to be moved downwardly gravity.

Since the weight of the sucker rod string, increased by the weight of the sinker areas if they are used, provides the force necessary to cause well fluids to flow upwardly through the tubing, if resistance to the downward movement of the traveling valve and to the sucker rod string by the upwardly flowing well fluids is great, especially past such obstructions to fluid flow as the connector means connecting adjacent ends of adjacent rods, the sucker rod string will move downwardly relatively slowly thus reducing the rate of production of he well fluids. The connector means decreases the flow space area between the rod and the tubing and also therefore increases the turbulence of the well fluids flowing therepast as well as increasing vibrations imparted to the string. In addition, if the traveling valve and lower end portions of the rod string offer a relatively great resistance to downward movement of the rod string, the weight of upper portions of the rod sting may cause the lowermost portions of the string to be placed under great compression loads which tend to cause such lower portions to bend and buckle and their connector means to be moved with great force against the internal surfaces of the tubing.

Such vibrational and longitudinal sliding frictional contact of the lower portion of the rod string with the tubing thus caused results in damage to and failure of the rods and also of the portions of the tubing engaged thereby. The thicker shank stabilizer rods usually provided with centralizers are used to decrease such contact, damage and failure and help hold the traveling valve properly aligned in the pump barrel.

The conventional API standard sucker rods and stabilizer bars or rods have connector means, such as threaded pins on the opposite ends of the rods and annular coupling stop shoulder, whose diameters vary in a set manner in accordance with the diameters of the shanks of the rods. For example, conventional sucker and stabilizer rods whose shanks are one inch in diameter have connector pins having an outside diameter of 1.3735 inches and pin or stop shoulders, which limit movement of the pins into couplings, that are 2.0 inches in diameter while rods which have three quarter of an inch diameter shanks have pins which have an outside diameter of 1.061 inches and in shoulders 1.5 inches in diameter. It will be seen therefore that the cross-sectional area of the pin stop shoulders of the standard three quarter inch diameter shank rod is only 1.777 square inches while that of the standard one inch shank rod is 3.1416 square inches. The cross sectional area of a flow passage between the connector means of a standard three quarter inch shanks rod and a standard well tubing, for example, having an internal diameter of 2.441 inches is therefore 2.930 square inches while that between the connector means of a standard one inch shank rod and the same tubing is only 1.555 square inches.

If a sucker rod string is provided, as has been the practice, with a stabilizer rod of greater strength and rigidity due to the greater diameter of its shank as compared to that of the shanks of the sucker rods of the strings, for example; one inch versus three quarters of an inch, the restriction of the flow passage in the tubing at the connector means at the opposite ends of the stabilizer rod are much greater than those of the locations of the connector means of the sucker rods. In addition, special adaptor or connector means must be provided to connect the connector pins of the stabilizer rod to the different sized pins of the sucker rods and to the sinker bar or pump travelling valve.

It is desirable that a stabilizer bar or rod be provided whose connector means, the pins and stop shoulders at its opposite ends, be of the same diameter as those of the other members of the well apparatus between and to which it is connected, even through its shank is of greater diameter than the shanks of such other members, in order that connection of such stabilizer or rod in a sucker rod sting not result in a decrease in the area of the flow passage between the tubing, in which the sucker rod string is reciprocally movable, and the string at the locations of the opposite ends of the stabilizer bar.

OBJECTS OF THE INVENTION

It is therefore an object of this invention to provide a new and improved stabilizer bar or rod which is connectible in a sucker rod string and whose connection in the string does not decrease the effective area of the flow passage between the string and the tubing in which it is reciprocably movable to a greater degree than the decrease of such flow passage by other members or sections of the string.

Another object is to provide a new and improved stabilizer rod which is connectible in a sucker rod string by the same connector means as are the other sucker rods of the string.

Still another object is to provide a stabilizer rod, of the type described, whose end connector means are of substantially the same diameter as the connector means of the sucker rods of the string in which the stabilizer rod is connectible.

SUMMARY OF THE INVENTION

A stabilizer rod connectible in a sucker rod string whose shank is of greater diameter than that of the sucker rods of the string and whose opposite end connector means are of the same dimensions and form as the opposite end connector means of the sucker rods of the string.

DESCRIPTION OF THE DRAWINGS

Other objects and advantages of the invention will be readily apparent from the reading of the following description of a stabilizer bar or rod constructed in accordance with the invention and reference to the accompanying drawings, wherein:

Referring now to FIGS. 1A and 1B of the drawings, the stabilizer bar or rod 10 embodying the invention is shown connected in, and as part of, a sucker rod string S between a conventional sucker rod 11 of the string, the stabilizer bar having a bottom threaded pin 40 threaded in the upwardly opening bore 15 of the cage 16 of the traveling valve TV of the usual tubing pump P connected inn the tubing T. The pump, being of a conventional well known sub-surface type, will not be described in greater detail.

Figure 1A:
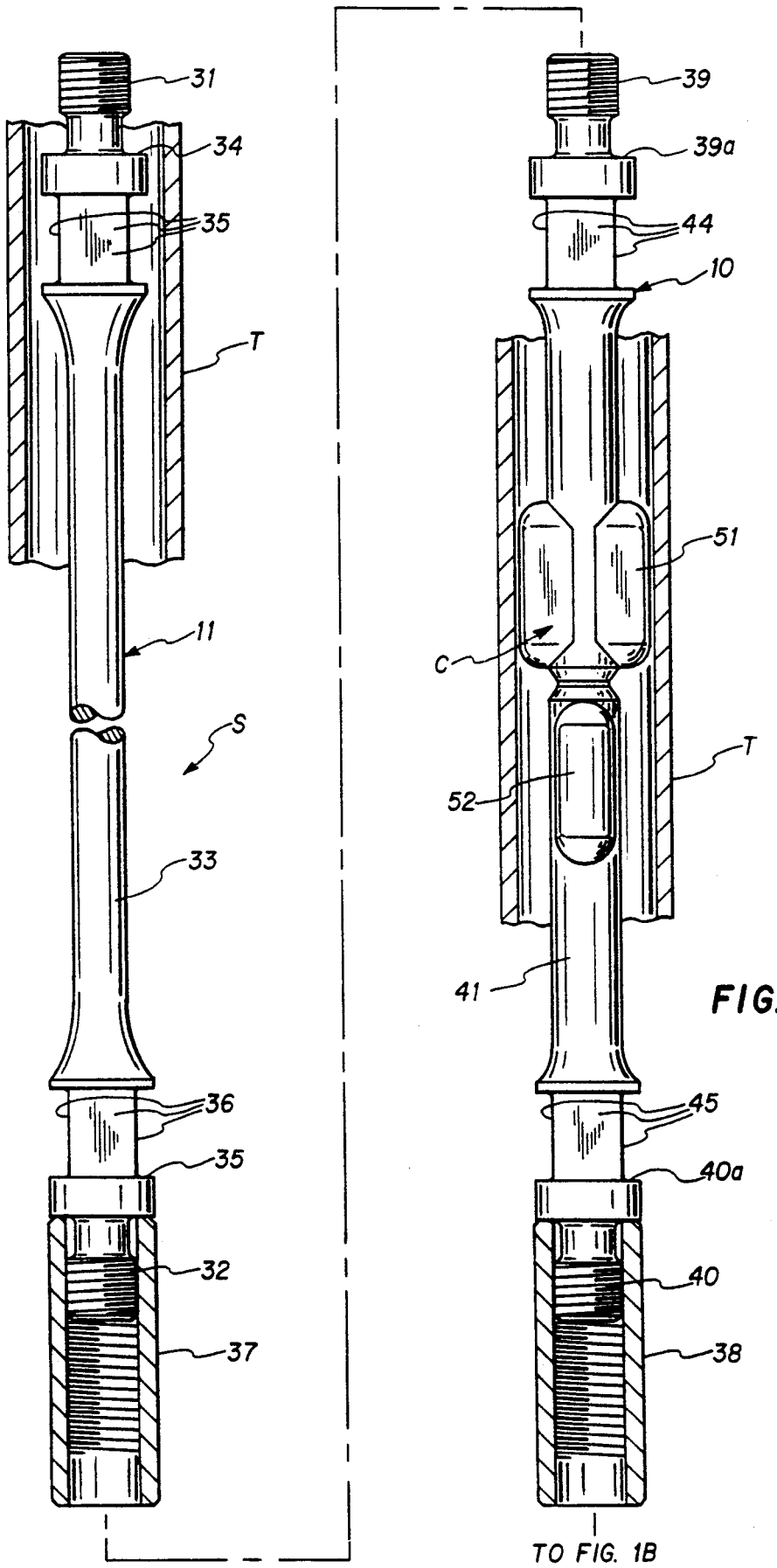
FIG. 1A is a longitudinal partly sectional view of a stabilizer rod embodying the invention and a sucker rod of the string.

The sucker rod 11 being a conventional API Standard three-quarter inch sucker rod, has pins 31 and 32 and a shake 33 three-quarter of an inch in diameter. The API Standard three-quarter inch sucker rods, such as the illustrated rod 11, have pins 31 and 32 which are 1.0611 inch in diameter and are 1.437 inches long. Their pin shoulders 34 and 35, respectively, have an outside diameter of 1.5 inches. Such sucker rods also have upper and lower sets of wrench flats 35*a* and 36, respectively.

The stabilizer bar or rod 10 of the invention is connected between and to the bottom end of the lowermost sucker rod 11 of the sucker rod string by a standard internally threaded coupling 37 into which it top pin 39 is threaded. The shank 41 of the stabilizer rod is greater in diameter than the three-quarter inch diameter of the shanks of the sucker rods of the sucker rod string being one inch and is of much shorter length, for example, twenty-four to sixty inches long between its top and bottom pin shoulders 39*a* and 40*a*, respectively, as compared to the twenty-five to thirty foot lengths of the sucker rods of the string such as the sucker rod 11.

The stabilizer rod has the usual top and bottom wrench flats 44 and 45 and is provided with a centralizer C intermediate its ends. The centralizer C may be of the type illustrated and described in the co-pending U.S. application for patent Ser. No. 07/50,369, filed Apr. 6, 1990 by Donald E. Sable. The centralizer C has two pairs of radially outwardly extending diametrically displaced and longitudinally spaced pairs of ribs 51 and 52 whose outside surfaces extend radially outwardly of the pin shoulders 39*a* and 40*a* of the stabilizer rod to prevent engagement of the pin shoulders with the internal surfaces of the tubing.

Figure 1C:
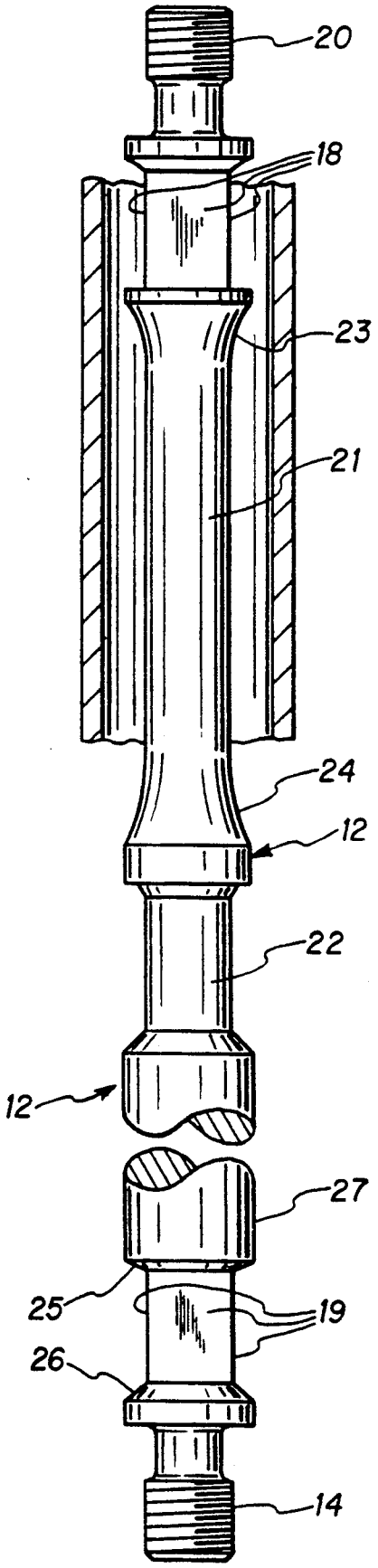
FIG. 1C is a longitudinal view of a sinker rod connectible in a sucker rod string.
Figure 1B:
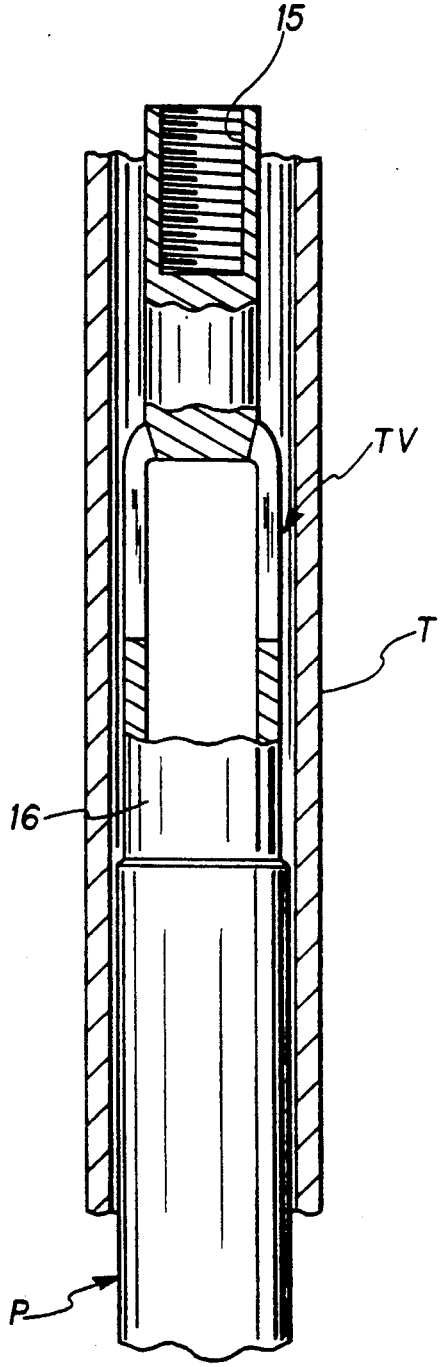
FIG. 1B is a fragmentary longitudinal partly sectional view of a sub-surface pump to whose traveling cage the stabilizer rod is connectible.

In many cases one or more sinker rods 12, FIG. 1C, may be connected between the lowermost sucker rod 11 nd the top end of the stabilizer rod by the same couplings as the coupling 37. It will be well known to those skilled in the art that usually a plurality of such sinker rods are connected serially between the lower most sucker rod 11 and the stabilizer rod to add a required calculated weight of the bottom of the sucker rod string to accelerate the downward movement of the sucker rod string during the downward stroke of the pumping cycle and to minimize flexing of the sucker rods of the strings above and stabilizer rod.

As illustrated, the tubing T is shown as being one of the commonly used standard sizes having a nominal internal diameter of 2.441 inches and therefore having a cross-sectional area or flow passage of 4.697 square inches.

The weight of sinker rod 12 is also of a commonly used well known type having the usual sets of wrench flats 18 and 19 adjacent opposite ends of the weight bar, bottom and top connector pins 14 and 20, and reduced portions 21 and 22 providing an upper set of longitudinally spaced facing shoulders 23 and 24 and a lower set of longitudinally spaced facing shoulders 25 and 26, respectively. These wrench flats and reduced portions with their facing shoulders are provided for engagement by well known surface tools during make-up and dis-assembly of the sucker rod string.

The reduced portions 21 and 22 are of relatively short lengths, for example, six inches and two and one half inches, respectively, and are one inch in diameter. The greater mass or weight of the sinker bar is provided by the section 27 between the portion 22 and the lower wrench flat as 19, the sections 27 being one and one-half inches in diameter and about twenty-four feet long.

The pins 14 and 20 at the ends of the weight or sinker rods shown are of the same dimensions and threads as the pins 31 and 32 of the sucker rods 11 and are connectible in the string by couplings identical to the coupling 37.

In use, the stabilizer bar or rod 10*e*, embodying the invention is usually connected between the lowermost sucker rod 11 of the string S or the lowermost sinker rod 12, if sinker rods are used, by means of the coupling such as the coupling 37. If sinker rods are not used the bottom end of the stabilizer rod is connected to the cage 16 of the travellings valve TV of the pump P by threading its pin 40 in the bore 15 of the travelling cage 16. In either case the pin shoulders 39*a* and 40*a* of the stabilizer rod are of the same diameter as the shoulders 34 and 35 of the sucker rod 11 and the stem of the travelling cage which has the bore 15.

It will be apparent therefore that even though the stabilizer rod has a shank which is of greater diameter and therefore of greater strength and rigidity than the shanks of the sucker rods of the sucker rod string in which it is connected and of which it constitutes a section, its connection in the string does not result in any decrease in the effective cross-sectional of the flow passage between the string and the internal surface of the tubing at the locations of its ends anymore than the other members of the string.

Figure 2:
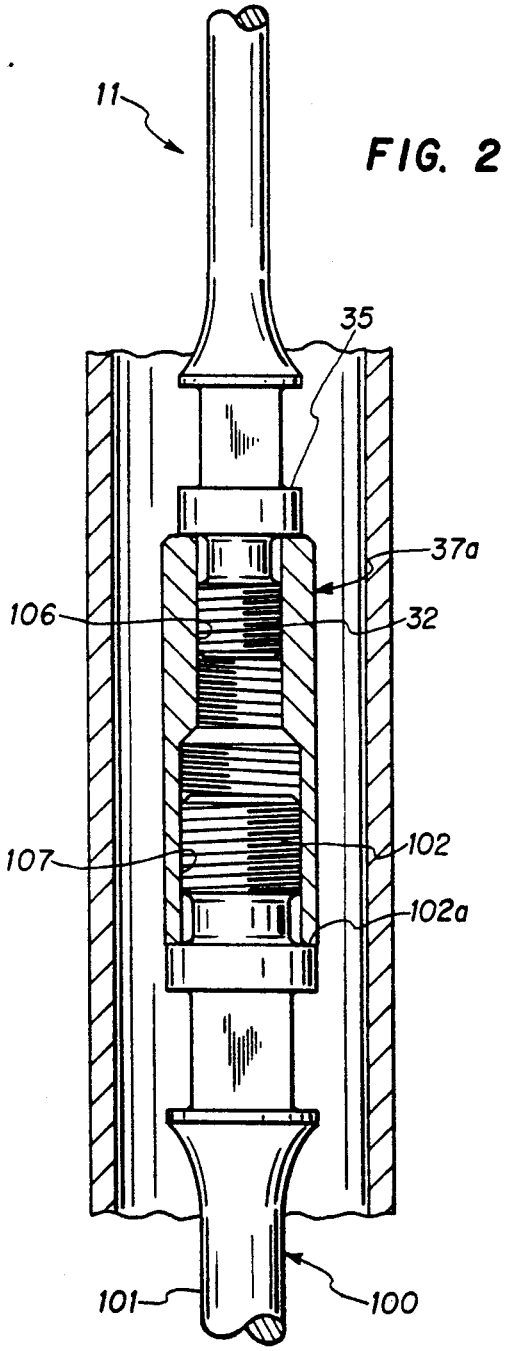
FIG. 2 is a longitudinal partly sectional view showing the connection of a conventional stabilizer bar to a sucker rod by a special coupling; and, FIG. 3 is a fragmentary sectional view showing another conventional connector means of adjacent ends of sucker rods.

Conventional API standard stabilizer or pony rods, such as the stabilizer bar 100, FIG. 2, whose shanks are 1.0 inches in diameter, have connector pins 102 at opposite ends thereof which are 1.375 inches in diameter and their pin shoulders, such as the top pin shoulder 102*a*, are 2.0 inches in diameter.

As a result, such stabilizer can be connected to the bottom end of the sucker rod only by use of a special coupling 37*a* whose bore has an upper threaded portion 106 to receive the pin 32 of the three quarter inch sucker rod 11, and a lower threaded portion 107 of greater internal diameter to receive the greater diameter pin of the stabilizer bar.

A special coupling also must be used to connect the bottom end if such standard stabilizer bar to the top end of the traveling cage.

As was pointed out above, use of such standard one inch shank stabilizer rod should drastically reduced the cross-sectional area of the flow passage in the tubing because of the increased diameter of its pin stop shoulders, such as the shoulder 102*a*, as compared to that of the corresponding shoulder of the one inch shank stabilizer of the invention illustrated in FIG. 1A, 2.0 inches versus 1.5 inches.

Figure 3:
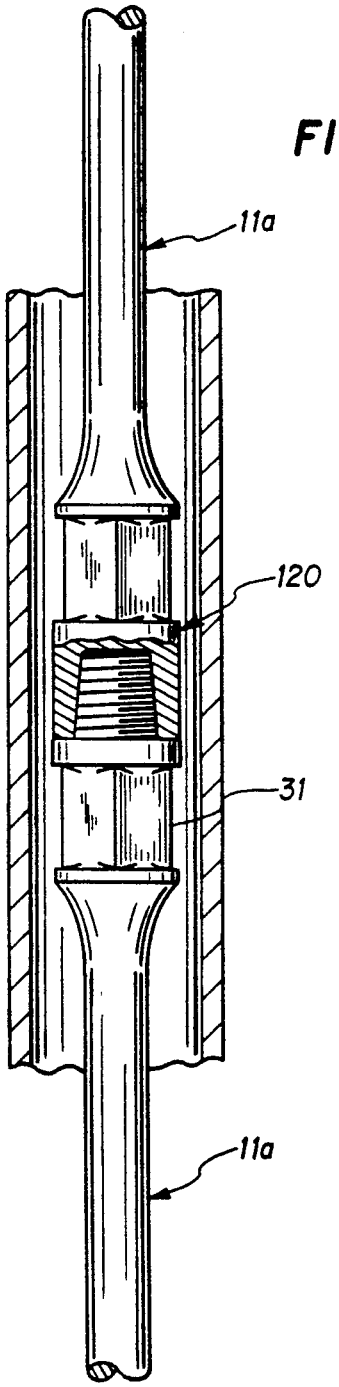

While the sucker rods have been illustrated as having connector pins at their opposite ends, the sucker rods, FIG. 3, may have a pin 31 on one end and an internally threaded socket or box 120 on the other end. In this case, couplings, such as the couplings 37 and 38 are not needed, but it will be apparent that a special connector rod, serving the same purpose as the special coupling 37*a*, would have to be used to connect the standard three quarter inch sucker rod to a standard one inch stabilizer rod.

It will now be seen that a new and improved stabilizer bar or rod has been illustrated and described which is connectible in a sucker rod string to provide increased strength and rigidity to the string, at locations at which the string is subjected to great stresses, which does not have any portion which is of greater diameter than the largest diameter of any portion of the other members of the sucker rod string.

It will also be seen that the stabilizer rod of the invention does not decrease the effective cross-sectional area of the flow passage of a tubing in which it is disposed to an extent greater than that caused by any other member of the sucker rod string.

It will further be seen that a new and improved stabilizer rod has been illustrated and described which is connectible in a sucker rod string whose sucker rods, such as the sucker rod 11, have connector means at their opposite ends, such as the pins 31 and 32 and shoulders 34 and 35, the stabilizer rod having a shank of greater diameter than the shank of the sucker rod to which it is connectible and connector mean at its opposite ends, such as the pins 39 and 40 and shoulders 39*a* and 40*a*, of the same dimensions as the connector means of the sucker rods of the string.

It will further be seen that the stabilizer bar may also be provided with centralizer means such as the Centralizer C, on and rigid with its shank.

While the stabilizer bar 10 has been shown as provided with a particular centralizer C it will be apparent that it may be provided with other centralizers of plastic rigidly secured to its shank or indeed may be of metal and integral with the shank.

It will also be seen that the wear, damage and failure of portions of the tubing and of the sucker rods is decreased because the connector means at opposite ends of the stabilizer rod do not cause any greater restriction of or obstruction to the upward flow of the well fluids in the tubing than do the connector means connecting adjacent ends of adjacent sucker rods even though the stabilizer rod is at the location of greatest stresses induced in the sucker rod string especially during the commencement of downward movement of the string.

It will also be seen that economies of cost, storage and handling of the components of the sucker rod string are achieved by use of the stabilizer rod embodying the invention since provision and use of special couplings such as the coupling 37*a* to connect the stabilizer rod in the string, are not required.

It will be apparent to those skilled in the art that while the illustrated and described stabilizer rod is shown as used with standard three quarter inch sucker rods, that stabilizer rods of different diameter shanks may be used in accordance with the invention with standard sucker rods having shanks of diameters either greater or smaller than three quarters of an inch. In each case, the stabilizer shank would be of greater diameter than the shanks of the sucker rods while its connector means would be of the same dimensions as the connector means of the sucker rods.

The foregoing description of the invention is explanatory only and changes in the details of the construction illustrated may be made by those skilled in the art within the scope of the appended claims without departing from the spirit of the invention.

What is claimed as new and desired to be secured by Letters Patent is:

1. A stabilizer rod connectible in a sucker rod string to constitute the bottom end portion of a rod sting and connect it to a reciprocable member of a well pump, the sucker rod string having sucker rods whose elongate shanks are provided at their opposite ends with enlarged connector means, said stabilizer rod comprising a shank of uniform diameter throughout its full and complete length and of greater diameter then the diameter of the shanks of the sucker rods of the string, and enlarged connector means of greater diameter than the diameter of said shanks, said connector means of said stabilizer rod being of no greater diameter than the diameter of the connector means of the sucker rods.

2. The stabilizer rod of claim 1, wherein said connector means at one end of said shank of said stabilizer rod comprises an annular shoulder and a threaded pin extending longitudinally outwardly from said shoulder.

3. The stabilizer rod of claim 2, and a centralizer on and rigid with said shank of said stabilizer rod having circumferentially spaced means extending radially outwardly of said annular shoulder.

4. The stabilizer rod of claim 1 wherein said shank of said stabilizer rod has a length not more than one-ninth the length of the shanks of the sucker rods.

5. The stabilizer rod of claim 4, wherein said connector means at one end of said shank of said stabilizer rod comprises an annular shoulder and a threaded pin extending longitudinally outwardly from said shoulder.

6. The stabilizer rod of claim 5, and a centralizer on and rigid with said shank of said stabilizer rod having circumferentially spaced means extending radially outwardly of said annular shoulder.

* * * * *